US005813384A

United States Patent [19]

Lavender et al.

[11] Patent Number: 5,813,384

[45] Date of Patent: Sep. 29, 1998

[54] INTAKE SYSTEM ARRANGEMENT FOR V-TYPE ENGINE

[75] Inventors: Stephen J. Lavender, Racine; Gregg R. Herde, Germantown, both of Wis.

[73] Assignee: Briggs & Stratton Corporation, Wauwatosa, Wis.

[21] Appl. No.: 915,354

[22] Filed: Aug. 20, 1997

[51] Int. Cl.[6] ..... F02B 75/22

[52] U.S. Cl. ..... 123/198 E; 123/184.32; 123/195 P

[58] Field of Search ..... 123/184.32, 195 P, 123/198 E, 196 W

[56] References Cited

U.S. PATENT DOCUMENTS

| | | | |
|---|---|---|---|
| 1,403,350 | 1/1922 | Short . | |
| 1,761,958 | 6/1930 | Anderson . | |
| 2,927,564 | 3/1960 | Turlay et al. . | |
| 3,742,923 | 7/1973 | Obländer et al. . | |
| 4,233,043 | 11/1980 | Catterson | 55/315 |
| 4,493,661 | 1/1985 | Iwai | 123/196 R |
| 4,658,767 | 4/1987 | Fujikawa et al. . | |
| 4,681,067 | 7/1987 | Tamba et al. | 123/41.1 |
| 4,697,557 | 10/1987 | Tamba et al. | 123/195 P |
| 4,781,635 | 11/1988 | Kinouchi et al. | 123/195 HC |
| 4,875,438 | 10/1989 | Suzuki et al. . | |
| 5,027,753 | 7/1991 | Hamazaki et al. . | |
| 5,031,591 | 7/1991 | Shinoda et al. | 123/196 W |
| 5,197,426 | 3/1993 | Frangesch et al. | 123/198 E |
| 5,387,163 | 2/1995 | Sakamoto et al. | 123/443 |
| 5,421,297 | 6/1995 | Tamba et al. | 123/193.5 |
| 5,485,817 | 1/1996 | Dahlberg | 123/198 E |
| 5,513,608 | 5/1996 | Takashima et al. | 123/196 W |
| 5,613,470 | 3/1997 | Shiomi et al. | 123/195 P |
| 5,617,821 | 4/1997 | Tsunoda et al. | 123/195 P |
| 5,630,390 | 5/1997 | Tsunoda et al. | 123/196 W |
| 5,669,358 | 9/1997 | Osakabe | 123/196 W |

FOREIGN PATENT DOCUMENTS

| | | |
|---|---|---|
| 55-46007 | 3/1980 | Japan . |

*Primary Examiner*—David A. Okonsky
*Attorney, Agent, or Firm*—Michael Best & Friedrich LLP

[57] ABSTRACT

An air intake system for an internal combustion engine has a vertical crankshaft and a pair of substantially horizontally disposed cylinders that extend outward from a crankcase to form a V-space therebetween. The air intake system includes an air inlet through a blower housing on top of the engine, an air cleaner housing that is disposed substantially directly above the V-space and that receives air from the air inlet, an air-fuel mixing device disposed substantially directly below the air cleaner, and an intake manifold adapted to deliver a combustible mixture from the air-fuel device to each cylinder. The air cleaner includes a filter supported such that air received from the air inlet flows through the filter in a substantially upward direction. The air cleaner housing and the blower housing are integrated into a single housing.

32 Claims, 6 Drawing Sheets

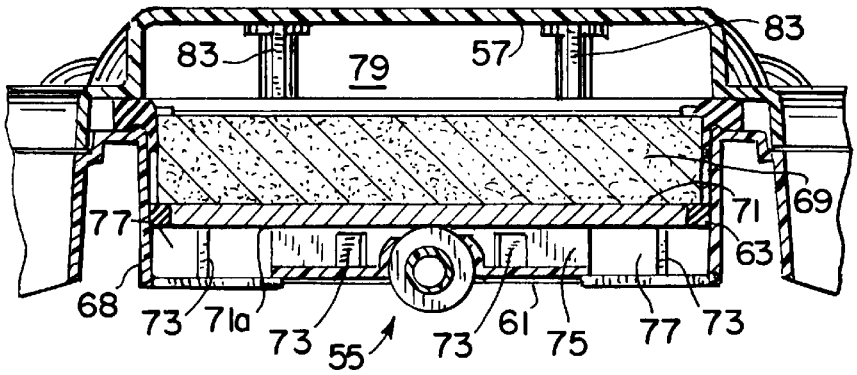
FIG. 8
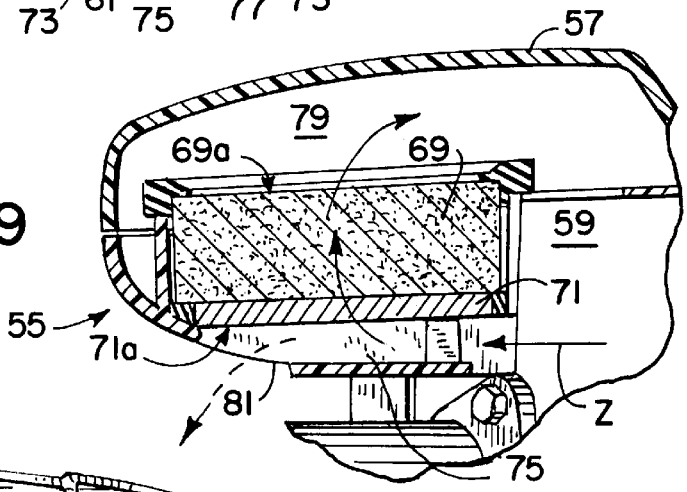
FIG. 9
FIG. 11
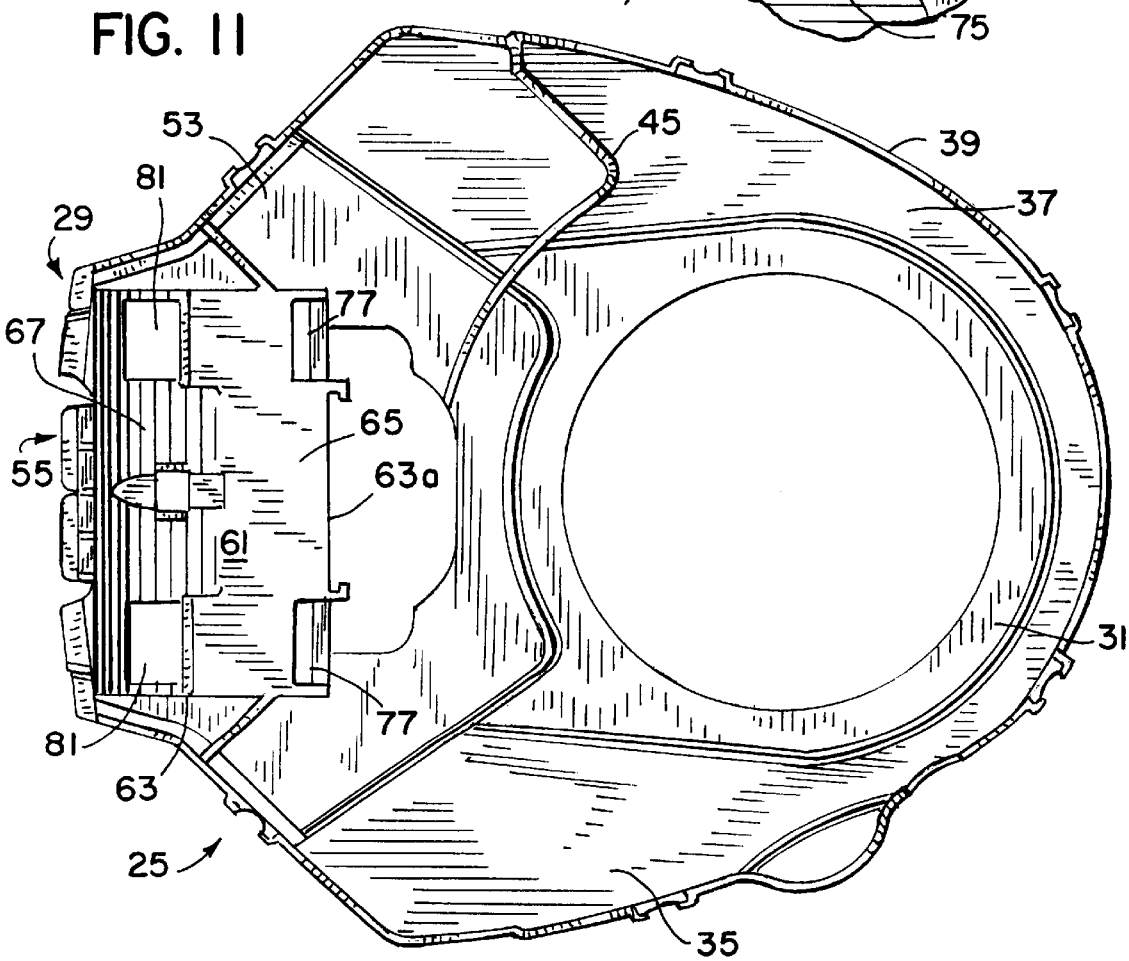

INTAKE SYSTEM ARRANGEMENT FOR V-TYPE ENGINE

FIELD OF THE INVENTION

The present invention relates to vertical shaft internal combustion engines of the V-type. More particularly, the present invention relates to an air intake system for a vertical shaft internal combustion engine.

BACKGROUND OF THE INVENTION

In a prior art vertical shaft V-type internal combustion engine, an air and fuel intake system is typically provided having a plurality of distinct components. Some components are located in the area adjacent to the cylinders, while other components are located elsewhere around the engine. The air intake component of the intake system delivers air to an air-fuel mixing device such as a carburetor, and the air-fuel mixing device delivers a combustible air-fuel mixture to each of the cylinders. The air and fuel intake system generally includes an air intake device, an air filter housing with a filter element contained therein, an air-fuel mixing device such as a carburetor, and an intake manifold disposed in fluid flow communication with each cylinder.

It is known to provide a blower fan and a blower housing disposed on top of the engine as an air intake device. Through duct work, the blower housing delivers air to a vertically-disposed air filter housing positioned in front of the cylinders. The air filter housing is disposed in front of, and is connected to, a carburetor disposed between the cylinders. Further, the carburetor is connected to an intake manifold disposed between the carburetor and the crankcase or above the carburetor. The intake manifold includes piping that leads to an intake valve in each cylinder.

In such an engine, the relative positions of the air filter housing, the carburetor, and the intake manifold may significantly impact, or even dictate, the width and/or height of the vertical shaft engine. When the engine is to be enclosed under a hood or cowl, it is preferable that these engine dimensions are minimized and that the engine is compact. Further, it is desirable to provide a work space around the air filter housing so that the filter element may be periodically monitored or accessed as necessary.

SUMMARY OF THE INVENTION

The present invention provides an air intake system that is particularly adaptable to a V-type internal combustion engine having a crankcase, a vertical crankshaft, and a pair of substantially horizontally-disposed cylinders that extend outwardly from the crankcase to define a V-space therebetween. The present air intake system functions to deliver clean filtered air to the cylinders or to an air-fuel mixing device. Several aspects of the invention relate to various air cleaning components of the air intake system. Other aspects of the invention relate to an arrangement of the air intake components wherein the height and width dimensions of the engine are minimized. Yet another aspect of the invention relates to an integral blower and air cleaner housing.

The air intake system includes an air intake inlet, an air cleaner that receives air from the air intake inlet, and an intake manifold positioned downstream of the filter and disposed in fluid flow communication with each of the cylinders. The air cleaner is preferably disposed substantially directly above the V-space and supports a filter such that air flows through the filter in a substantially upward direction. An air-fuel mixing device is preferably disposed substantially directly below the air cleaner and substantially within the V-space, while the intake manifold extends from the air-fuel mixing device in a substantially radially outward direction relative to the crankshaft.

Moreover, the filter may be disposed such that an inlet side of the filter faces substantially downwardly and/or an outlet side of the filter faces substantially upwardly. The air cleaner may further include an inlet opening, and the filter may be supported such that air received through the inlet opening makes an abrupt turn before passing through the inlet side. A second opening in the air cleaner is designed such that particulate matter entrained in air received through the inlet opening is discharged through the second opening. Moreover, the air cleaner preferably includes a cover that may be removed to expose the outlet side of the filter.

Alternatively, the air cleaner may include a housing with a wall, and the filter may be supported such that the inlet side of the filter and the wall define a compartment therebetween. The compartment preferably includes an inlet opening that receives air from the air intake inlet.

The present invention also provides an integral housing that includes a blower housing and an air cleaner housing. The blower housing substantially encloses a blower fan rotatably mounted near a top end of the crankshaft. The blower housing is adapted such that the blower fan draws air through the blower opening and the blower housing directs the air across the cylinders. Further, the air cleaner draws air from the blower housing and directs the air through a filter in a substantially upwardly direction. The air cleaner is disposed substantially directly above the V-space.

It is a feature and an advantage of the present invention to provide a vertical shaft, V-type internal combustion engine having a compact construction.

It is a feature and an advantage of the present invention to provide an air intake system adaptable to a vertical shaft, V-type engine that is both compact and efficient.

It is a feature and an advantage of the present invention to provide an air intake system wherein an air filter is readily accessible and easy to maintain.

It is a feature and an advantage of the present invention to provide an integral air cleaner-blower housing which is easy to manufacture and easy to assemble.

The above and other objects, features and advantages of the invention will become apparent from the following detailed description of a preferred embodiment and from the accompanying drawings.

BRIEF DESCRIPTION OF THE DRAWINGS

FIG. 8 is a vertical sectional view through the air cleaner housing, along line 8—8 of FIG. 7.

FIG. 9 is a partial vertical sectional view along line 9—9 of FIG. 7.

FIG. 11 is a bottom view of an integral air cleaner-blower housing.

DETAILED DESCRIPTION OF THE DRAWINGS

Figure 1:
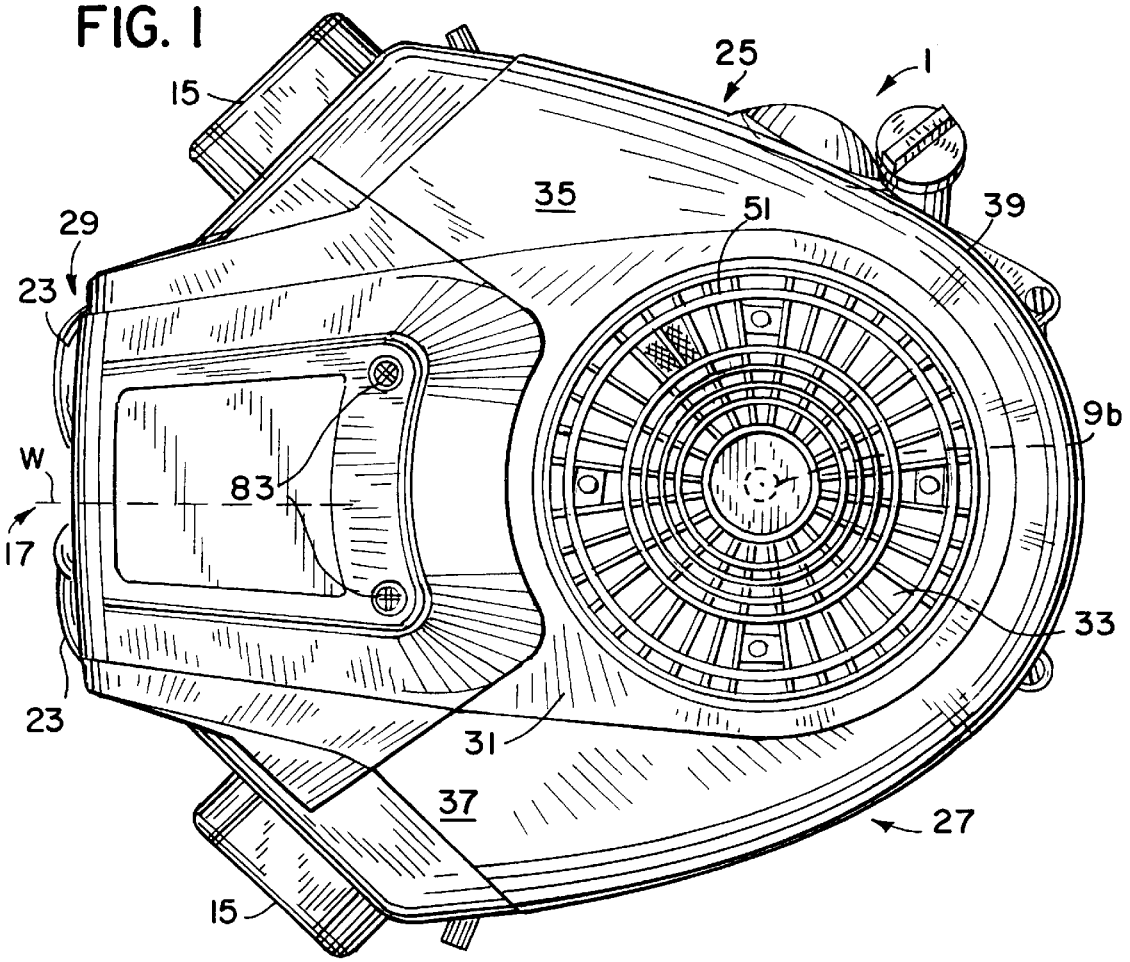
FIG. 1 is a top view of a vertical shaft, V-type engine, including an integral air cleaner-blower housing according to the present invention mounted on the top of the engine.
Figure 2:
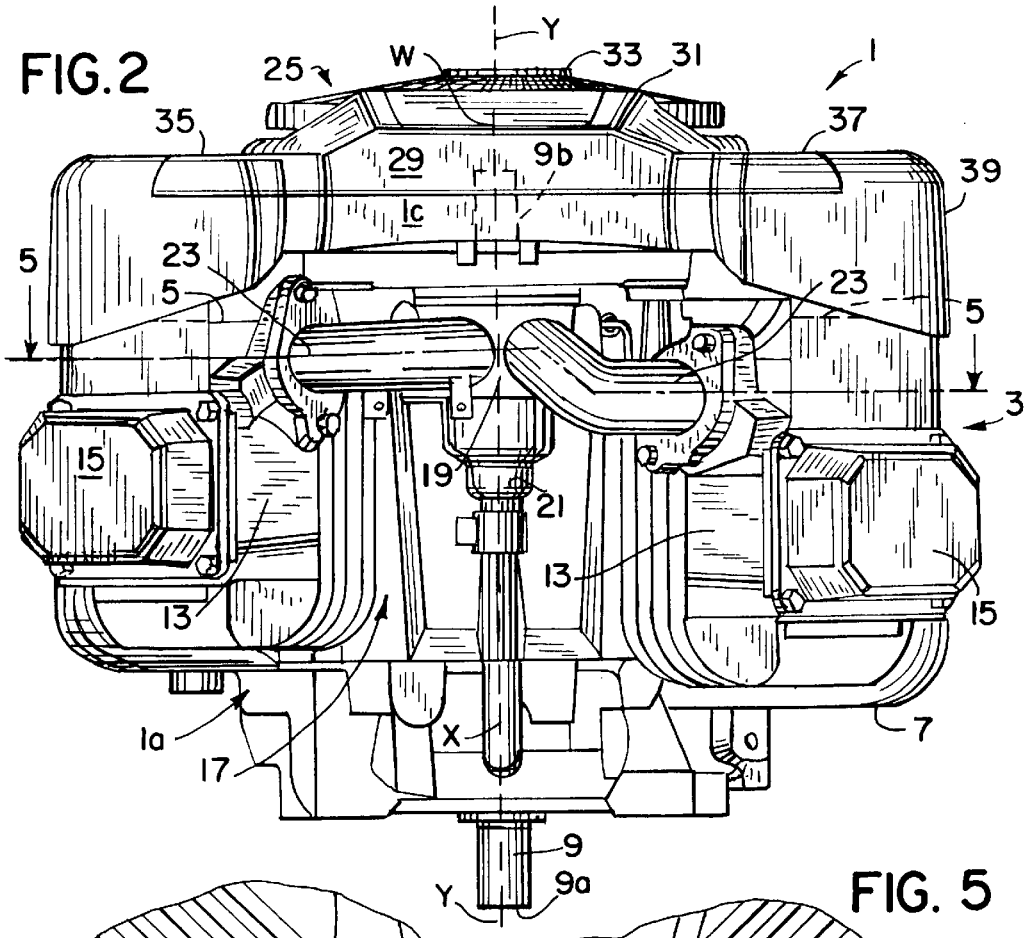
FIG. 2 is a front elevation view of the engine depicted in FIG. 1.
Figure 5:
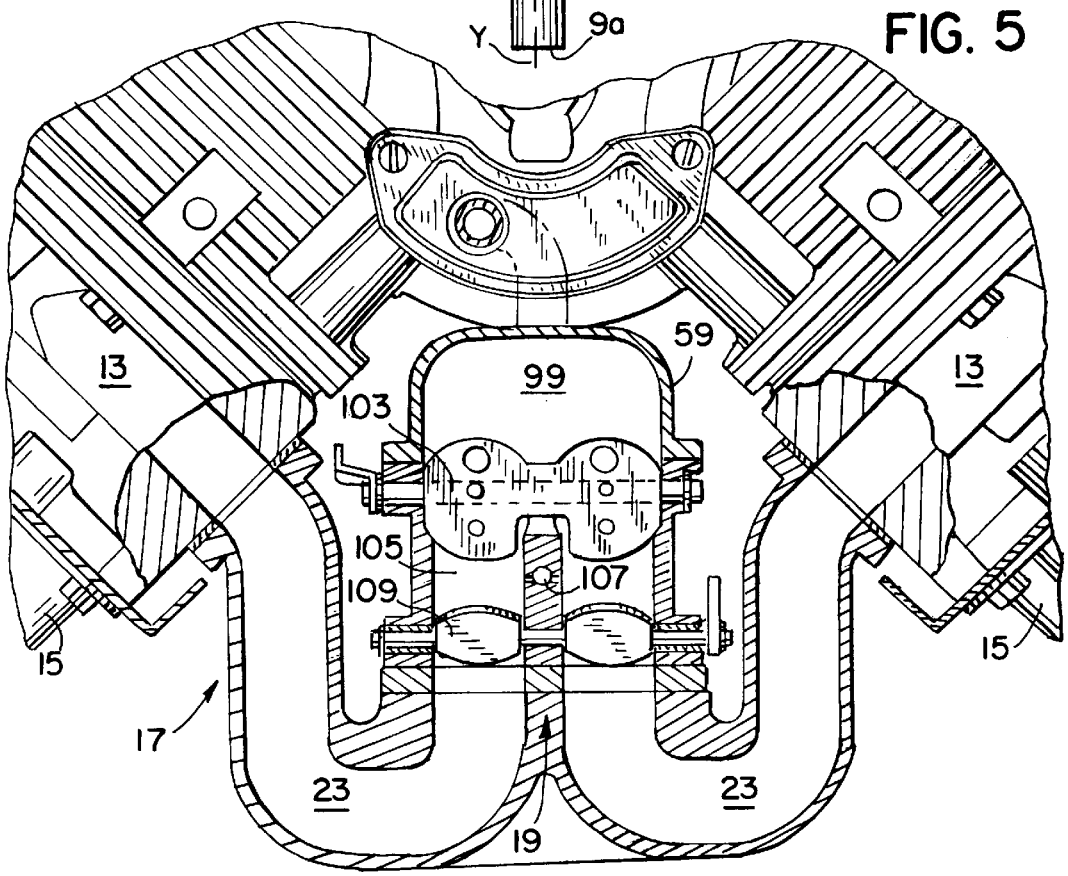
FIG. 5 is a partial sectional view through line 5—5 of FIG. 2.
Figure 6:
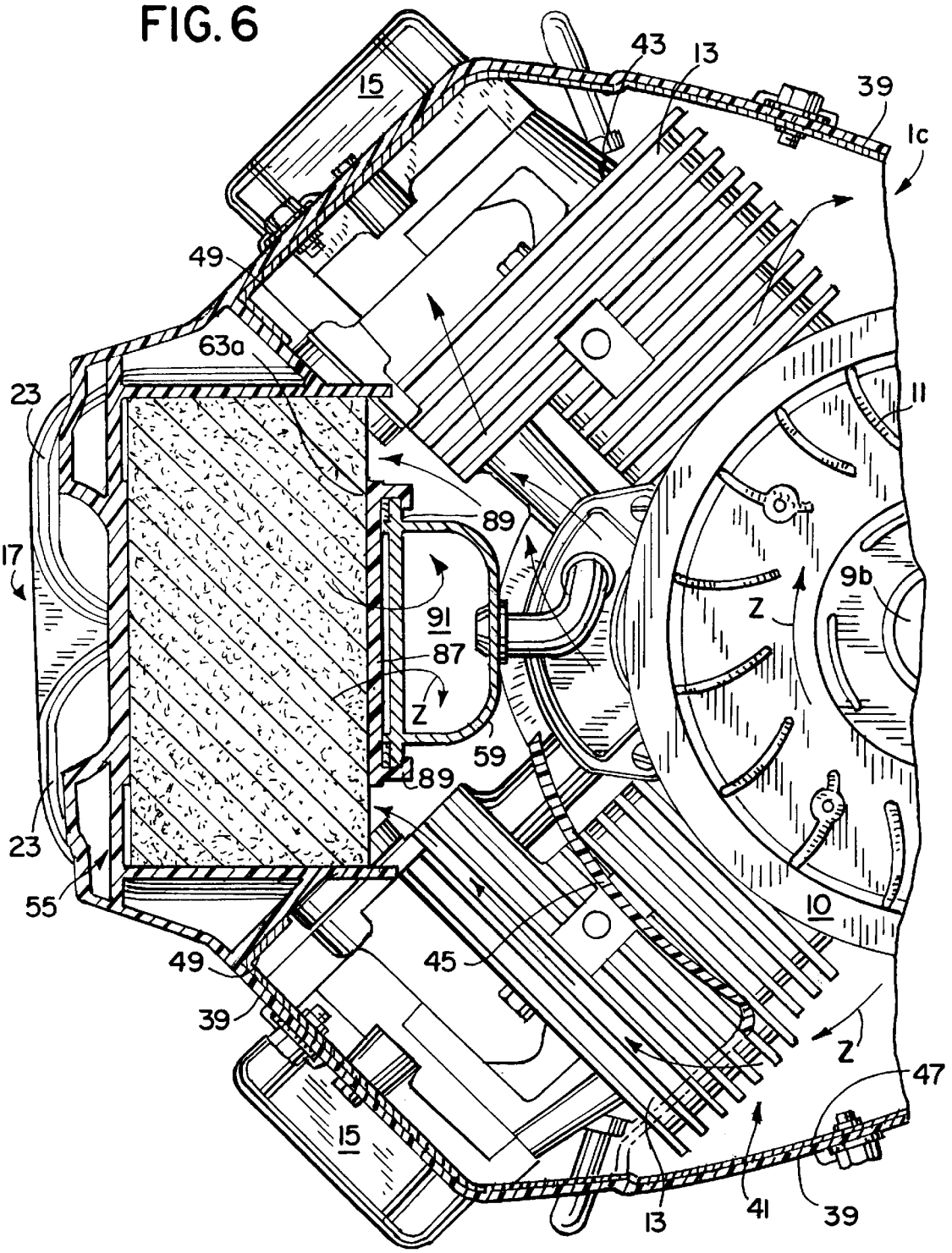
FIG. 6 is a partial sectional view along line 6—6 of FIG. 4.

A vertical shaft, V-type engine 1 incorporating different aspects of the present invention is depicted in FIGS. 1 through 11. Referring specifically to FIG. 2, the engine 1 includes a crankcase 3 with a top wall 5 and a bottom wall 7. A crankshaft 9 is supported within the crankcase 3 and extends vertically through the top wall 5 and the bottom wall 7. A power take-off end 9*a* of the crankshaft 9 is disposed below the bottom wall 7, while a top end 9*b* (see FIG. 6) is disposed above the top wall 5. Referring to FIG. 6, a flywheel 10 and a blower fan 11 are mounted near the top end 9*b* of the crankshaft 9, vertically spaced from the top wall 5.

Figure 3:
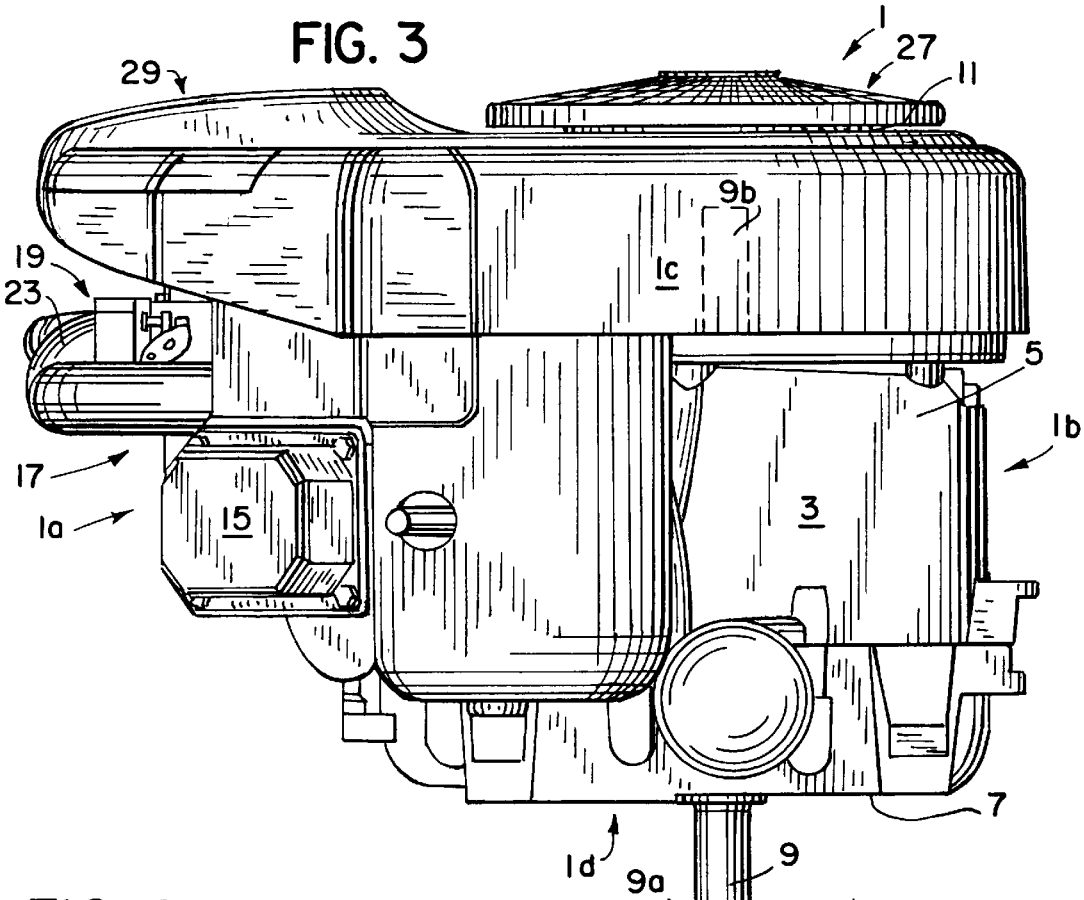
FIG. 3 is a side elevation view of the engine depicted in FIG. 1.

For purposes of this detailed description and with reference to FIG. 3, the engine 1 is referred herein as having a front portion 1*a* (also shown in FIG. 2), a rear portion 1*b* disposed opposite the front portion 1*a*, a top portion 1*c* over which the blower fan 11 is mounted (see also FIG. 6), and a bottom portion 1*d* defined by the outside surface of the bottom wall 7. The front portion 1*a* is characterized by a pair of substantially horizontally-disposed cylinders 13 that extend outwardly from the crankcase 3. A cylinder cover 15 is mounted to the outward end of each cylinder 13.

Referring to FIG. 2, the cylinders 13 and the crankcase 3 substantially define a V-space 17 therebetween. The V-space 17 extends outwardly from the crankcase 3 to the space between the cylinder covers 15 and vertically from the bottom of the cylinders 13 to an elevation approximately equal to the elevation of the top 1*c* of the engine 1. A carburetor assembly 19 including a fuel bowl 21 is situated substantially within the V-space 17. A center vertical plane X of the V-space 17 bisects the center of the fuel bowl 21 and is coplanar with a rotational axis Y of the crankshaft 9 (see also FIG. 1). An intake manifold includes a pair of intake elbows 23 that extend radially outward relative to the crankshaft 9 from the front of the carburetor assembly 19. Each elbow 23 functions to deliver an air-fuel mixture to each cylinder 13.

Referring to FIGS. 1 and 2, an integral housing 25 is mounted above the engine 1 and substantially envelopes the top 1*c* of the engine 1. The integral housing 25 is a single piece enclosure preferably molded from a plastic material. The integral housing 25 includes a blower housing 27 that substantially encloses the blower fan 11 and the top of the cylinders 13, and an air cleaner housing 29 disposed substantially at the front 1*a* of the engine 1 and substantially directly above the V-space 17 (FIG. 2).

Figure 7:
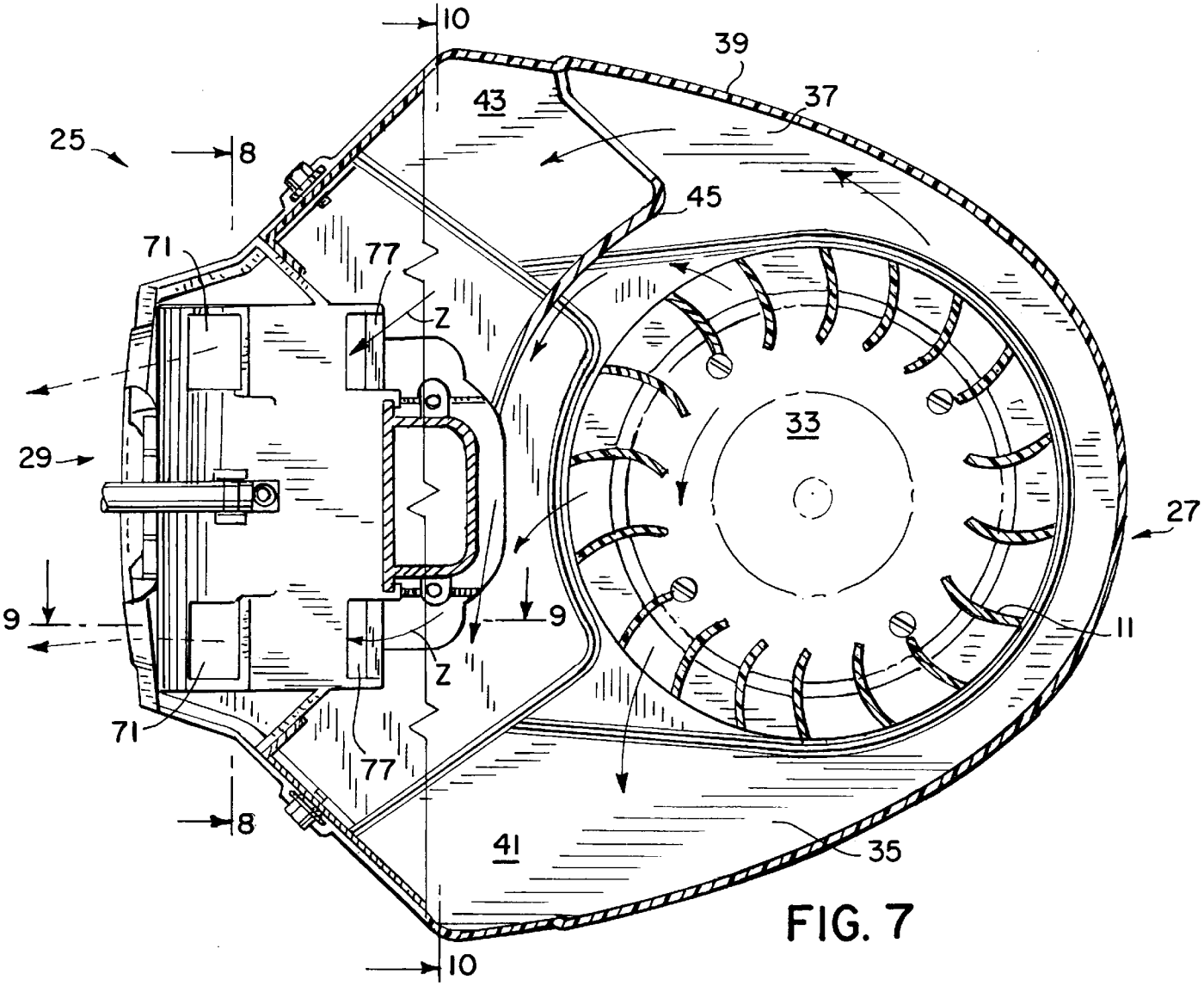
FIG. 7 is a bottom sectional view along line 7—7 of FIG. 4.

The blower housing 27 comprises a central top wall 31 including a removable circular grille 33, a left top wall 35 disposed substantially over a left cylinder 13, a right top wall 37 disposed substantially over a right cylinder 13, and a sidewall 39 that extends downwardly from the top walls 31,35,37 and interfaces the periphery of the top 1*c* of the engine 1. The top walls 31,35,37 and the sidewall 39 generally converge near the rear of the engine 1, where the sidewall 39 has a semi-cylindrical shape that closely corresponds with the shape of the circular grille 33. The top walls 31,35,37 are disposed generally horizontally and are vertically spaced from the top 1*c* of the engine 1 to create gaps or compartments 41,43 between the underside of the blower housing 27 and the top 1*c* of the engine 1 (see FIG. 6). A right compartment 41 is disposed directly underneath the right top wall 37 and a left compartment 43 is disposed directly underneath the left top wall 35. Referring also to the bottom view of the integral housing 25 depicted in FIG. 7 and the sectional elevation view of FIG. 10, a baffle wall 45 extends downwardly from the right top wall 37 and laterally across the right compartment 41. Referring to FIGS. 6 and 7, the sidewall 39 is bolted to vertical interface plates 47 that project upwardly from the periphery of the top 1*c* of the engine 1 and from around the cylinders 13. Accordingly, the sidewall 39 effectively encloses the blower housing 27.

Figure 4:
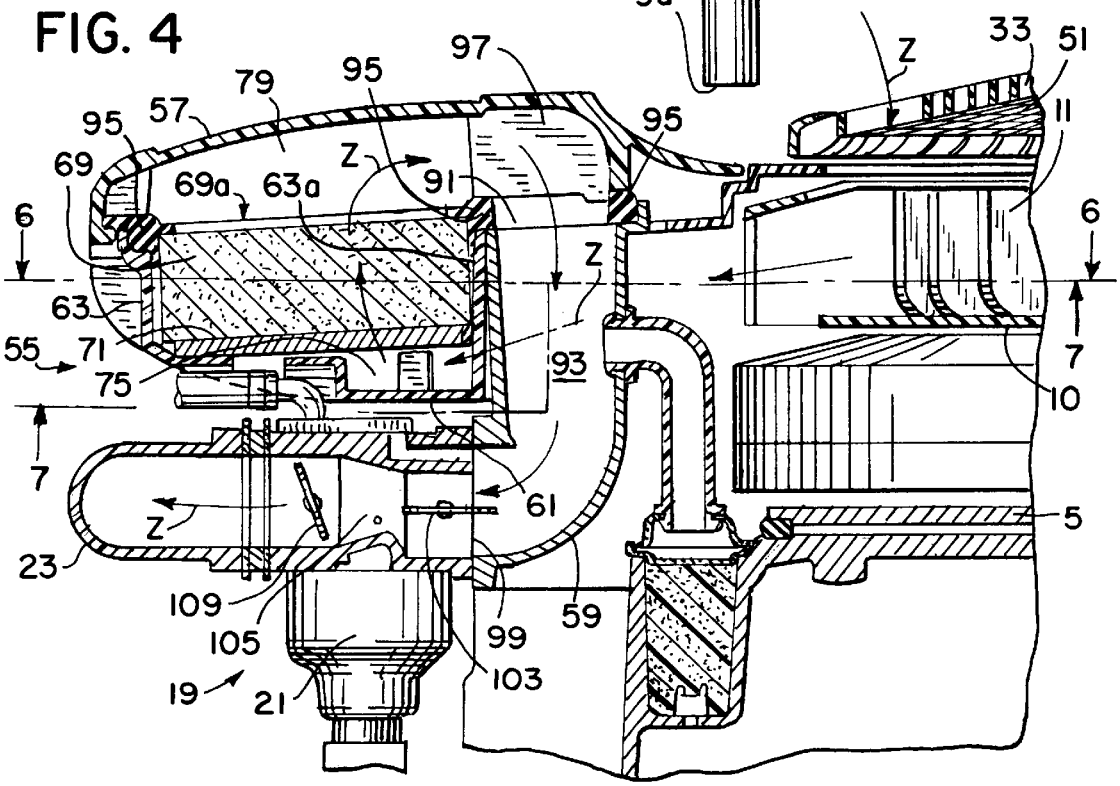
FIG. 4 is a vertical sectional view of the engine depicted in FIG. 3.

FIGS. 4 and 6 illustrate through arrows Z the path of air flow Z underneath the integral housing 25. Rotation of the blower fan 11 induces ambient air to flow downwardly through the grille 33 and into the center of the blower fan 11. The grille 33 is preferably equipped with a screen 51 to provide initial filtering of the air intake. The blower fan 11 then disperses the air generally horizontally outward towards the right, left, and front of the blower fan 11. Since the rear portion of the integral housing 25 is substantially closed off, blades 11*a* of blower fan 11 rotate through the rear portion without substantially dispersing air outward until the blades 11*a* engage the substantially open right compartment 41. Consequently, more air is dispersed into the right compartment 41 of the blower housing 27 than into the left compartment 43. However, due to the strategic placement of the baffle wall 45, some of the air flow Z in the right compartment 41 is directed to the left compartment 43, thereby compensating for the uneven flow dispersal between the left 43 and right compartments 41. Accordingly, the blower housing 27 directs generally even flow distribution over the top and sides of each cylinder 13.

Figure 10:
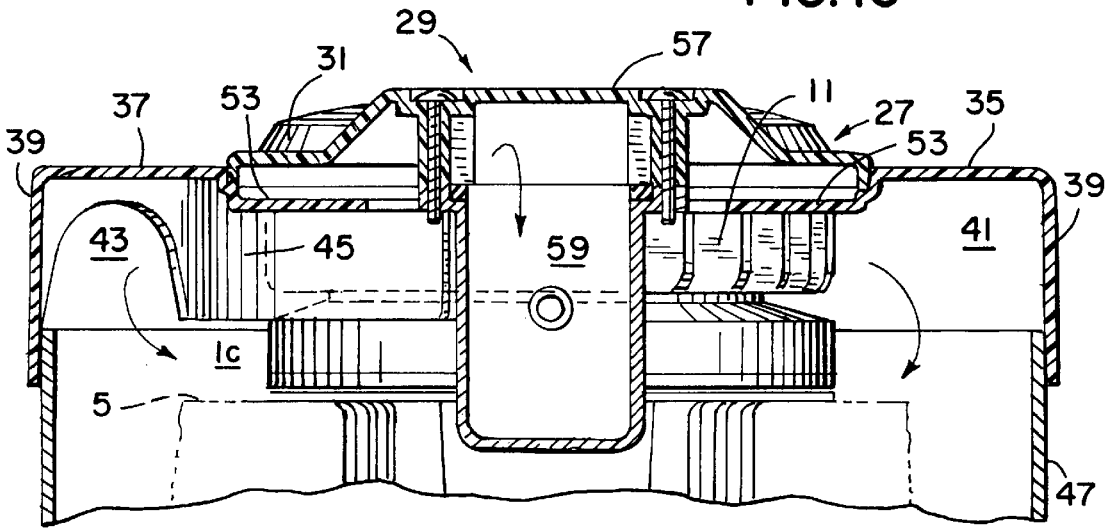
FIG. 10 is a vertical sectional view along line 10—10 of FIG. 7.

Referring to FIGS. 10 and 11, the air cleaner housing 29 provides a slightly elevated front portion of the integral housing 25. The air cleaner housing 29 comprises a generally horizontal lower wall 53 (FIG. 11), an air filter box 55 disposed in front of the lower wall 53 (see also FIG. 1), and a removable top cover 57 extending over the lower wall 53, the air filter box 55, and a substantially vertically disposed air cleaner elbow 59 (FIG. 10). As best shown in FIG. 2, the air cleaner housing 29 is disposed directly above the V-space 17, such that a vertical center plane W of the air cleaner housing 29 is substantially coplanar with the vertical center plane X of the V-space 17 and of the carburetor assembly 19.

Referring now to FIGS. 8 and 11, the air filter box 55 is defined by a bottom section 61 disposed substantially directly above the carburetor assembly 19 (FIG. 4), four vertical walls 63 extending upwardly from the bottom section 61 and including a rear wall 63*a*, and the top cover 57. The bottom section 61 is further defined by a generally flat inlet portion 65 at the rear and an upwardly sloped front portion 67 that extends from the inlet portion 65.

The air filter box 55 contains two filter elements—an upper filter 69 and a lower filter 71—that are disposed generally horizontally, with the upper filter 69 immediately above the lower filter 71. The filter elements 69,71 have substantially similar rectangular dimensions, but the upper filter or primary filter 69 is substantially thicker than the lower filter or pre-filter 71. Preferably, the primary filter 69 is a paper filter element while the pre-filter 71 is a coarse-type filter. The filter elements 69,71 are supported inside the air filter box 55 by vertical support columns 73 provided on the bottom section 61 (see FIG. 4). The support columns 73 elevate the filters 69,71 such that a downwardly-facing surface or side 71*a* of the pre-filter 71 and the bottom section 61 define a lower compartment 75 of the air filter box 55 therebetween (see also FIG. 4).

Further, a pair of inlet openings 77 are formed adjacent the intersection of the rear wall 63*a* and the bottom section 61. The inlet openings 77 have a horizontal component and a vertical component that are both in fluid flow communication with the forced air flow Z around the blower fan 11 (see FIG. 6). Since the air filter box 55 (as will be explained in further detail below) is in fluid flow communication with the cylinders 13, low pressure fluctuation in the cylinders 13 draws rapid air flow Z from the blower housing 27, particularly from high velocity air flow in the left compartment 43 and right compartment 41, through each inlet opening 77 (see also FIG. 4).

Referring to FIG. 9, air flow Z enters the lower compartment 75 of the air filter box 55 flowing in a generally horizontal direction. Upon entering the lower compartment 75, however, the air flow Z is forced to make an abrupt upward turn to engage the downwardly facing side 71*a* of the pre-filter 71. The air flow Z enters through the pre-filter 71 and primary filter 69 before exiting through an outlet surface or side 69*a* of the primary filter 69. From the outlet side 69*a* of the primary filter 69, the air flow Z enters a top compartment 79 of the air filter box 55 that is disposed directly below the top cover 57. Then, the air flow Z is forced to make another abrupt rearward turn before entering the air cleaner intake elbow 59.

Referring now to FIGS. 9 and 11, the lower compartment 75 is also provided with a pair of discharge outlets 81 disposed on the sloped portion 67, opposite each of the inlet openings 77. Air flow Z is therefore drawn through the inlet openings 77 and out through discharge outlets 81. When the air flow Z is forced to make an abrupt upward turn in the direction of the downwardly facing side 71*a* of the pre-filter 71, heavier particulate matter entrained in the air flow Z is typically carried by fluid momentum toward the sloped portion 67 of the bottom section 61 rather than continuing upwardly with the air flow Z. This particulate matter is eventually discharged through the discharge outlets 81 and purged from the air intake system.

Because the air Z flows substantially upwardly through the filter elements 69,71, the "dirty" side of the filter elements 69,71 is typically on the bottom. Further, vibration of the engine 1 generally causes filtered matter within the filter elements 69,71 to shake loose and collect on the bottom of the filter elements 69,71. Some of this collected dirt eventually falls on to the bottom section 61 and is preferably purged out through the discharge outlets 81.

As best shown in FIG. 4, the top cover 57 extends over the top compartment 79 of the air filter box 55 and over the air cleaner elbow 59. Referring to FIGS. 7 and 8, the top cover 57 is preferably secured in place by two vertically extending bolts 83 that engage flanges 85 on either side of the air cleaner elbow 59 (see also FIG. 1). Thus, the top cover 57 may be easily removed to expose the outlet side 69*a* of the primary filter 69 and to afford access to both filters 69,71.

Because the top cover 57 is provided on top of and at the front of the vertical shaft engine 1, the operator is afforded easy access to the top cover 57, even when the engine 1 is enclosed within a hood or cowl. Accordingly, the filter elements 69,71 are easy to monitor and to replace as required.

Referring now to FIG. 4, the air cleaner elbow 59 extends downwardly through the lower wall 53 and into the V-space 17. A vertical railing 87 is provided on the outside of the rear wall 63*a* (see FIG. 6). The single-piece air cleaner elbow 59 is secured adjacent to the rear wall 63*a* by way of vertical flanges 89 that slidably engage the vertical railing 87 (FIG. 6). An inlet opening 91 of the air cleaner elbow 59 is disposed generally horizontally at the top of a straight conduit portion 93 (FIG. 4). Further, an integral seal 95 is disposed around the outlet side 69*a* of the primary filter 69 and around the horizontal inlet opening 91 of the air cleaner elbow 59, and seals both the air cleaner elbow 59 and the air box 55 from the rest of the air cleaner housing 29.

Referring to FIG. 4, an inlet compartment 97 is provided above the inlet opening 91 of the air cleaner elbow 59 and below the top cover 57. The front of the inlet compartment 97 opens into the top compartment 79 of the air filter box 55. Accordingly, air Z exiting the primary filter 69 is forced to make a 90° turn into the inlet compartment 97, and then another 90° turn into the air cleaner elbow inlet opening 91, before flowing downwardly through the air cleaner elbow 59. At the bottom of the air cleaner elbow 59, the air flow Z is forced to make another 90° turn. At the end of the bottom turn, a vertically disposed outlet opening 99 of the air cleaner elbow 59 faces the carburetor assembly 19.

Referring now to FIG. 5, the carburetor assembly 19 comprises two barrels, or throats 101, each including a choke 103 upstream of the outlet 99 of the air cleaner elbow 59, a venturi 105 in fluid flow communication with a common fuel nozzle 107 and disposed downstream of the choke 103, and a throttle 109 disposed downstream of the venturi 105. The carburetor assembly 19 also includes the fuel bowl 21 that is disposed immediately below the venturies 105.

It should be noted that the present air intake system is adaptable to engines utilizing air-fuel mixing devices other than the carburetor depicted in the drawings. For example, the present invention is adaptable to an engine utilizing a fuel injector in the cylinders. In light of the disclosure provided herein, adaptation of the air intake system depicted in the drawings to such engines will be apparent to one of ordinary skill in the engine art.

Referring to both FIGS. 4 and 5, the air flow Z through each carburetor throat 101 is substantially linear and horizontal. In each venturi 105, the air is mixed with a fuel to form a combustible mixture. From the venturi 105, the combustible mixture in each throat 101 is directed outward through the throttle 109 and into one of the intake elbows 23.

Each intake elbow 23 extends outward from the throttle 109 and outside the V-space 17. Then, the intake elbow 23 turns approximately 180° in the direction of one of the cylinders 13 and back into the V-space 17. Each intake elbow 23 is in fluid flow communication with an intake valve (not shown) located on an upper portion of the cylinder 13, thereby providing a pathway through which combustible mixture is delivered into the cylinder 13.

As best shown in FIGS. 5 and 6, substantially all of intake elbows 23, carburetor assembly 19, and air cleaner elbow 59 are disposed directly below the air cleaner housing 29. More specifically, the carburetor assembly 19 is disposed substantially directly below the air filter box 55, and along with the bottom of the air cleaner elbow 59, is situated substantially within the V-space 17. Thus, the V-space 17 is substantially utilized and the width and height dimensions of the engine 1 are minimized.

In summary, ambient air Z is introduced into the air intake system through the horizontal circular grille 33 (see FIG. 4). The blower fan 11 generates air flow Z over the top and sides of the cylinders 13, thereby convectively cooling the cylinders 13. Some of the air flow Z is drawn into the lower compartment 75 of the air filter box 55 through inlets 77 and discharged through discharge outlets 81. Low pressure conditions in the cylinders 13 periodically draw air Z from the lower compartment 75, thereby forcing the air flow Z to make an abrupt upwardly turn and to engage the downwardly facing inlet side 71*a* of the pre-filter 71. The air Z then flows upwardly through the pre-filter 71 and the primary filter 69 before exiting into the top compartment 79. The air flow Z is then forced to make a 180° turn from the top compartment 79 to the air cleaner elbow 59. The air flow Z through the air cleaner elbow 59 is substantially downward until, at the bottom, where the air flow Z is forced to make another 90° turn before entering the carburetor assembly 19.

The air flow Z through the carburetor assembly 19 is split between the two carburetor throats 101. In each venturi 105, the air mixes with fuel to create a combustible mixture. The combustible mixture is then directed outward from the carburetor assembly 19 into two separate intake elbows 23 that deliver the combustible mixture to each cylinder 13.

While a preferred embodiment of the present invention has been illustrated and described, alternate embodiments will be apparent to those skilled in the art and are within the intended scope of the present invention. Therefore, the scope of the present invention is to be limited only by the following claims:

What is claimed is:

1. An air intake system for an internal combustion engine, the engine having a crankcase, a vertically extending crankshaft, and at least one pair of substantially horizontally disposed cylinders that extend outwardly from the crankcase to form a V-space therebetween, said intake system comprising:

an air intake inlet;

an air cleaner including a filter and adapted to receive air from said air intake inlet such that said air flows through said filter in a substantially upward direction, said air cleaner being disposed substantially directly above the V-space; and an intake manifold positioned downstream of said filter and disposed in fluid flow communication with each of the cylinders.

2. The intake system of claim 1, wherein said filter has an inlet side that faces substantially downwardly.

3. The intake system of claim 1, wherein said filter has an outlet side that faces substantially upwardly.

4. The air intake system of claim 1, further comprising:

an air-fuel mixing device positioned downstream of said filter and upstream of said intake manifold, said air-fuel mixing device being disposed substantially directly below said air cleaner.

5. The air intake system of claim 4, wherein said air-fuel mixing device is substantially disposed within said V-space.

6. The air intake system of claim 4, wherein said intake manifold extends from said air-fuel mixing device in a substantially radially outward direction relative to said crankshaft.

7. The air intake system of claim 1, wherein said filter has an inlet side and wherein said air cleaner includes an inlet opening, said filter being supported such that air received through said inlet opening makes an abrupt turn before passing through said inlet side.

8. The air intake system of claim 7, wherein said air cleaner further includes a second opening, said air cleaner being adapted such that particulate matter entrained in air received through said inlet opening is discharged through said second opening.

9. The air intake system of claim 1, wherein said air cleaner includes a housing with a wall, and wherein said filter has an inlet side, said filter being supported within said housing such that said inlet side and said wall define a compartment therebetween, said compartment having an inlet opening that receives air from said air intake inlet.

10. The air intake system of claim 1, wherein said air cleaner includes a cover, said cover being removable to expose an outlet side of said filter.

11. The air intake system of claim 1, wherein the engine includes a blower fan rotatably mounted near a top end of the crankshaft, said air intake system further comprising:

an integral housing including:

a blower housing at least partially enclosing the blower fan, wherein said air intake inlet includes a blower opening in said blower housing, the blower housing being adapted such that the blower fan draws air through said blower opening and said blower housing directs said air across the cylinders; and an air cleaner housing that contains said filter, said air cleaner housing being disposed in fluid flow communication with said blower housing such that said filter receives air directed by said blower housing.

12. An air intake system for an internal combustion engine, the engine having a crankcase, a vertically extending crankshaft, and at least one pair of substantially horizontally disposed cylinders that extend outwardly from the crankcase to form a V-space therebetween, said intake system comprising:

an air intake inlet;

an air cleaner including a filter and adapted to receive air from said air intake inlet, said air cleaner being disposed substantially directly above the V-space;

an air-fuel mixing device positioned downstream of said filter, said air-fuel mixing device being disposed substantially directly below said air cleaner; and an intake manifold adapted to deliver a combustible mixture from said air-fuel mixing device to the cylinders.

13. The air intake system of claim 12, wherein said air cleaner is adapted to receive air from said air intake inlet such that said air flows through said filter in a substantially upward direction.

14. The air intake system of claim 12, wherein said filter element has an inlet side that faces substantially downwardly.

15. The air intake system of claim 12, wherein said filter element has an outlet side that faces substantially upwardly.

16. The air intake system of claim 12, wherein said air-fuel mixing device is substantially disposed within said V-space.

17. The air intake system of claim 12, wherein said intake manifold extends from said air-fuel mixing device in a substantially radially outward direction relative to the crankshaft.

18. The air intake system of claim 12, wherein said filter has an inlet side and wherein said air cleaner includes an inlet opening, said filter being supported such that air received through said inlet opening makes an abrupt turn before passing through said inlet side.

19. The air intake system of claim 18, wherein said air cleaner further includes a second opening, said air cleaner being adapted such that particulate matter entrained in air received through said inlet opening is discharged through said second opening.

20. The air intake system of claim 12, wherein said air cleaner includes a housing with a wall, and wherein said filter has an inlet side, said filter being supported within said housing such that said inlet side and said wall define a compartment therebetween, said compartment having an inlet opening that receives air from said air intake inlet.

21. The air intake system of claim 12, wherein said air cleaner includes a cover removable to expose an outlet side of said filter element.

22. The air intake system of claim 12, wherein the engine includes a blower fan rotatably mounted near a top end of the crankshaft, said air intake system further comprising:

an integral housing including:

a blower housing substantially enclosing the blower fan, wherein said air intake inlet includes a blower opening in said blower housing, the blower housing being adapted such that the blower fan draws air through said blower opening and said blower housing directs said air across the cylinders; and an air cleaner housing that contains said filter, said air cleaner housing being disposed in fluid flow communication with said blower housing such that said filter receives air directed by said blower housing.

23. An integral housing mounted on an internal combustion engine, the engine having a crankcase, a vertically extending crankshaft, a blower fan rotatably mounted near a top end of the crankshaft, and at least one pair of substantially horizontally disposed cylinders that extend outwardly from said crankcase to define a V-space therebetween, said integral housing comprising:

a blower housing disposed over the blower fan, said blower housing including an air inlet; and an air cleaner housing that supports a filter therein such that said filter is disposed substantially directly above the V-space, said air cleaner housing being adapted to receive air from said blower housing and to direct said air substantially upwardly through said filter, said filter being disposed in fluid flow communication with each cylinder.

24. The integral housing of claim 23, wherein the engine includes an air-fuel mixing device positioned downstream from said filter and adapted to deliver a combustible mixture to each of the cylinders, and wherein said air cleaner housing is disposed substantially directly above said air-fuel mixing device.

25. The integral housing of claim 24, wherein said air-fuel mixing device is disposed substantially within said V-space.

26. The integral housing of claim 23, wherein said filter has an inlet side that faces substantially downwardly.

27. The integral housing of claim 23, wherein said filter has an outlet side that faces substantially upwardly.

28. The integral housing of claim 23, wherein said air cleaner housing includes an inlet opening, and wherein said filter has an inlet side, said filter being supported such that air received through said inlet opening makes an abrupt turn before passing through said inlet side.

29. The integral housing of claim 23, wherein said air cleaner housing further includes a second opening, said air cleaner housing being adapted such that particulate matter entrained in air received through said inlet opening is discharged through said second opening.

30. The integral housing of claim 23, wherein said air cleaner housing includes a wall, and wherein said filter has an inlet side, said filter being supported within said air cleaner housing such that said inlet side and said wall define a compartment therebetween, said compartment having an inlet opening that receives air from said air intake inlet.

31. The integral housing of claim 23, wherein said air cleaner housing includes a cover, said cover being removable to expose an outlet side of said filter.

32. The integral housing of claim 23, wherein said air cleaner housing includes a removable cover, said cover being disposed on a top surface of said air cleaner housing.

* * * * *